United States Patent [19]

Ohshima et al.

[11] Patent Number: 5,014,659

[45] Date of Patent: May 14, 1991

[54] REINFORCED STRUCTURE OF A CYLINDER BLOCK OF AN INTERNAL COMBUSTION ENGINE

[75] Inventors: Hirofumi Ohshima; Masanori Sato; Kazuo Isayama, all of Hiroshima, Japan

[73] Assignee: Mazda Motor Corporation, Hiroshima, Japan

[21] Appl. No.: 556,251

[22] Filed: Jul. 19, 1990

[30] Foreign Application Priority Data

Sep. 12, 1989 [JP] Japan ..... 1-107568[U]

[51] Int. Cl.[5] ..... F02F 7/00

[52] U.S. Cl. ..... 123/195 H; 123/195 C

[58] Field of Search ..... 123/195 H, 195 C, 195 R

[56] References Cited

U.S. PATENT DOCUMENTS

| | | | |
|---|---|---|---|
| 4,453,509 | 6/1984 | Hayashi | 123/195 H |
| 4,458,640 | 7/1984 | Shimada | 123/195 H |
| 4,467,754 | 8/1984 | Hayashi et al. | 123/195 H |
| 4,474,148 | 10/1984 | Kikuchi | 123/195 H |
| 4,729,352 | 3/1988 | Fukuo et al. | 123/195 C |
| 4,831,978 | 5/1989 | Iguchi et al. | 123/195 H |
| 4,848,293 | 7/1989 | Sasada et al. | 123/195 C |
| 4,911,118 | 3/1990 | Kageyama et al. | 123/195 H |

FOREIGN PATENT DOCUMENTS 0134733 10/1980 Japan ..... 123/195 C

*Primary Examiner*—Willis R. Wolfe
*Assistant Examiner*—Thomas N. Moulis
*Attorney, Agent, or Firm*—Wenderoth, Lind & Ponack

[57] ABSTRACT

An internal combustion engine having a reinforced cylinder block, a skirt portion integrally formed therewith at a lower portion thereof, a plurality of bearings received therein, a crank shaft journaled in the bearings, a plurality of bearing caps secured to the bearings, and front and rear covers formed at front and rear portions of the cylinder block, respectively, and having respective openings through which the crank shaft extends. In order to reinforce the cylinder block, a reinforcing member is secured to a lower surface of the skirt portion of the cylinder block and to a lower surface of the rear cover. At least two first bolts for fastening the reinforcing member to the lower surface of the rear cover are provided on opposite sides of the rear cover while at least two second bolts for fastening the reinforcing member to a bearing cap for a rearmost bearing of the bearings are placed within a pitch of the first bolts in a direction transversely of the cylinder block.

5 Claims, 4 Drawing Sheets

REINFORCED STRUCTURE OF A CYLINDER BLOCK OF AN INTERNAL COMBUSTION ENGINE

BACKGROUND OF THE INVENTION

1. Field of the Invention

The present invention generally relates to a cylinder block of an internal combustion engine, and more particularly, to a reinforced structure of the cylinder block.

2. Description of the Prior Art

U.S. Pat. No. 4,831,978 discloses a reinforced structure of a cylinder block of an internal combustion engine. A plurality of bearings, in which a crank shaft is journaled, are received in the cylinder block and have respective caps rigidly secured thereto. The crank shaft extends through an opening formed in a rear cover of the cylinder block. A reinforcing member is fastened to a lower surface of a skirt portion of the cylinder block by means of bolts.

In this kind of cylinder block, the reinforcing member is also fastened to the rear cover by means of bolts so that oil contained in the cylinder block may not leak outside through the joint between the rear cover and the reinforcing member. Notwithstanding this fact, oil leakage occasionally occurs for such a structure.

More specifically, the cylinder block of the above-described type is provided with an oil seal interposed between the inner periphery of the opening of the rear cover and the outer periphery of the rear end of the crank shaft for preventing oil leakage. Because of this, the bolts for fastening the reinforcing member to the rear cover cannot be provided near the central portion of the lower surface of the rear cover due to the location of the outer diameter of the oil seal. Particularly, the rear end of the crank shaft is made larger in diameter because a transmission is connected thereto, thus inevitably causing the oil seal to be large in diameter. As a result, the problem arises that the pitch of the bolts for fastening the reinforcing member to the rear cover becomes long.

Accordingly, these fastening bolts cannot ensure sufficient surface pressure, thus occasionally causing oil leakage through the joint between the rear cover and the reinforcing member secured thereto.

SUMMARY OF THE INVENTION

Accordingly, the present invention has been developed to substantially eliminate the above-described disadvantage inherent in the prior art reinforced cylinder block of an internal combustion engine, and has as its essential object to provide an improved reinforced structure of the cylinder block, which can prevent oil leakage through the joint between a rear cover and a reinforcing member.

Another important object of the present invention is to provide a reinforced structure of the above-described type which is simple in construction and can be readily manufactured at a low cost.

In accomplishing these and other objects, an internal combustion engine, to which the present invention is applied, comprises a cylinder block, a skirt portion integrally formed therewith at a lower portion thereof, a plurality of bearings received therein, a crank shaft journaled in the bearings, a plurality of bearing caps secured to the bearings, and front and rear covers formed at front and rear portions of the cylinder block, respectively, and having respective openings through which the crank shaft extends.

In order to reinforce the cylinder block, a reinforcing member is secured to a lower surface of the skirt portion of the cylinder block and to a lower surface of the rear cover.

Furthermore, at least two first bolts for fastening the reinforcing member to the lower surface of the rear cover are provided on opposite sides of the rear cover while at least two second bolts for fastening the reinforcing member to a bearing cap for a rearmost bearing are placed within the pitch of the first bolts in a direction transversely of the cylinder block.

In the above-described structure, the fastening force caused by the bolts for fastening the reinforcing member to the rearmost bearing cap can sufficiently raise the surface pressure of the joint of the reinforcing member with the rear cover at a location between the bolts for fastening the reinforcing member to the rear cover.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
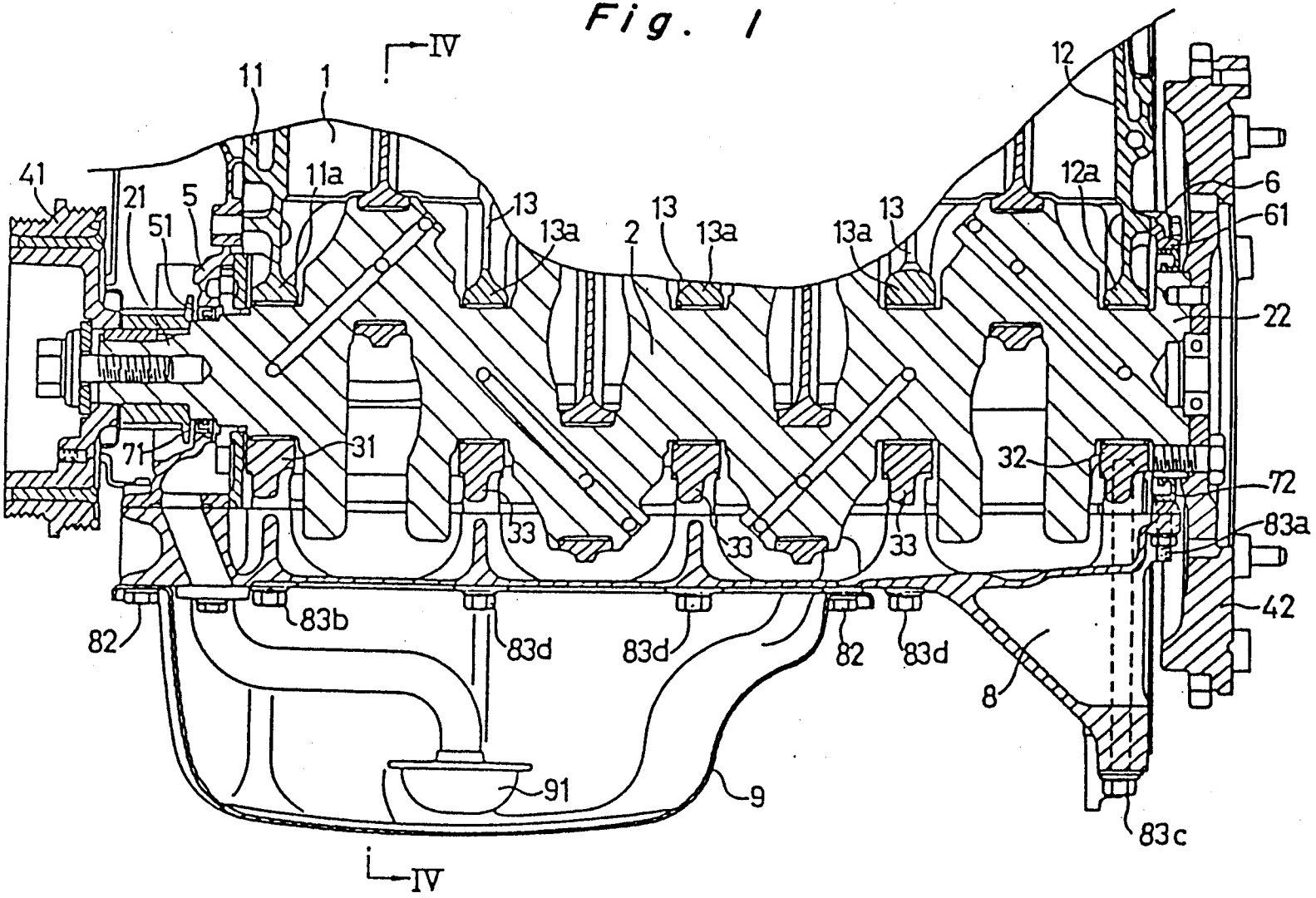
FIG. 1 is a vertical sectional view of a reinforced cylinder block of an internal combustion engine according to one preferred embodiment of the present invention.

FIGS. 1 to 4 depict a reinforced cylinder block of an internal combustion engine according to one preferred embodiment of the present invention. The cylinder block, generally shown by 1, has a skirt portion la integrally formed therewith at a lower portion thereof, the lower end of which is opened. A plurality of partition walls 11, 12 and 13 for partitioning cylinders are formed inside the cylinder block 1. A crank shaft 2 rotatably mounted in the cylinder block 1 is journaled in two main bearings 11*a* and 12*a* received in the frontmost and rearmost partition walls 11 and 12, respectively, and in a plurality of subbearings 13*a* received in the other partition walls 13. Main bearing caps 31 and 32 and subbearing caps 33 are fastened to the main bearings 11*a* and 12*a* and to the subbearings 13*a*, respectively.

The front and rear ends 21 and 22 of the crank shaft 2 protrude outside the cylinder block 1 through the frontmost and rearmost partition walls 11 and 12, respectively. A belt pulley 41 for driving auxiliary machinery, for example a cooling pump or the like, is rigidly secured to the front end 21 of the crank shaft 2 whereas a flywheel 42 is rigidly secured to the rear end 22 of the crank shaft 2.

A front cover 5 and a rear cover 6 are mounted on a front surface of the partition wall 11 and a rear surface of the partition wall 12, respectively. The front and rear covers 5 and 6 have respective openings 51 and 61 formed therein, through which the front and rear ends 21 and 22 of the crank shaft 2 extend. Oil seals 71 and 72 are interposed between the inner periphery of the opening 51 and the front end 21 of the crank shaft 2 and between the inner periphery of the opening 61 and the rear end 22 of the crank shaft 2, respectively, thereby preventing oil contained in the cylinder block 1 from leaking outside.

A relatively large transmitting torque is imposed upon the rear end 22 of the crank shaft 2 because an input shaft of a transmission unit (not shown) is connected thereto. Accordingly, the rear end 22 of the crank shaft 2 is made larger in diameter than the front end 21 thereof. For this reason, the rear oil seal 72 is larger in diameter than the front oil seal 71, and the opening 61 formed in the rear cover 6 is larger in diameter than the opening 51 formed in the front cover 5.

The skirt portion la of the cylinder block 1 extends downwardly to substantially the same level of the lower ends of the bearing caps 31, 32 and 33. A reinforcing member 8 is secured to the lower end surface of the skirt portion la by means of fastening bolts 82.

An oil pan 9 of aluminum casting or the like is secured to the lower surface of the reinforcing member 8. Oil stored in the oil pan 9 is introduced to various movable members, for example the crank shaft 2, by an oil pump (not shown) through a strainer 91.

The reinforcing member 8 is also secured to the lower end surface of the rear cover 6 by means of fastening bolts 83*a* consisting of stud bolts and nuts. The reinforcing member 8 is further secured to the lower end surfaces of the main bearing caps 31 and 32 and the sub-bearing caps 33 by means of fastening bolts 83*b*, 83*c* and 83*d*, respectively.

Figure 3:
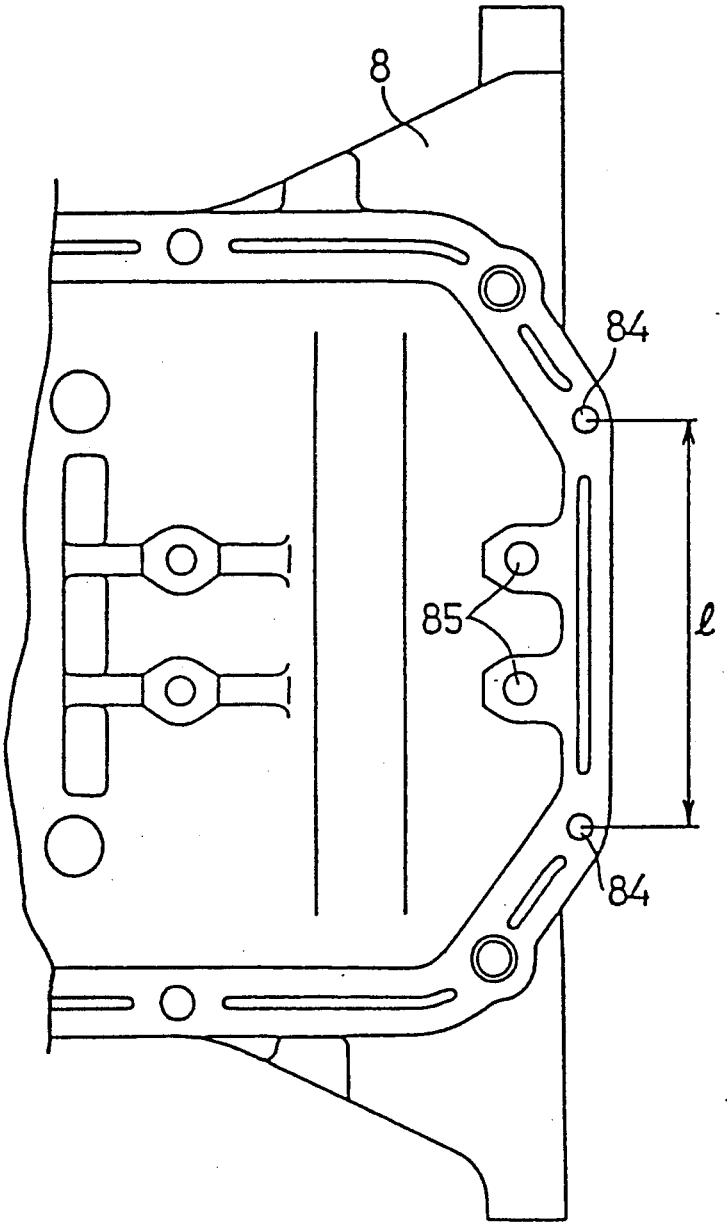
FIG. 3 is a top plan view of a reinforcing member provided in the cylinder block of FIG. 1.
Figure 4:
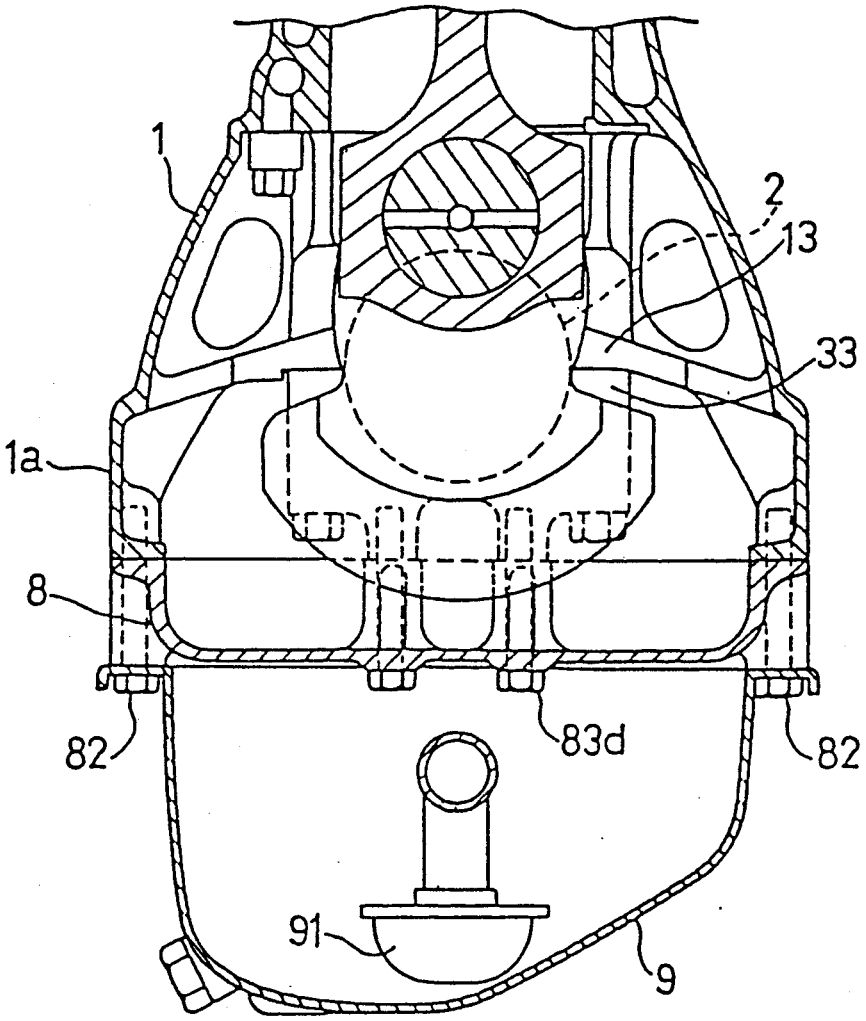
FIG. 4 is a sectional view taken along line IV—IV in FIG. 1.

FIG. 3 depicts a rear end portion of the reinforcing member 8, in which bolt holes 84 and 85 are formed for receiving the fastening bolts 83*a* and 83*c*, respectively.

Figure 2:
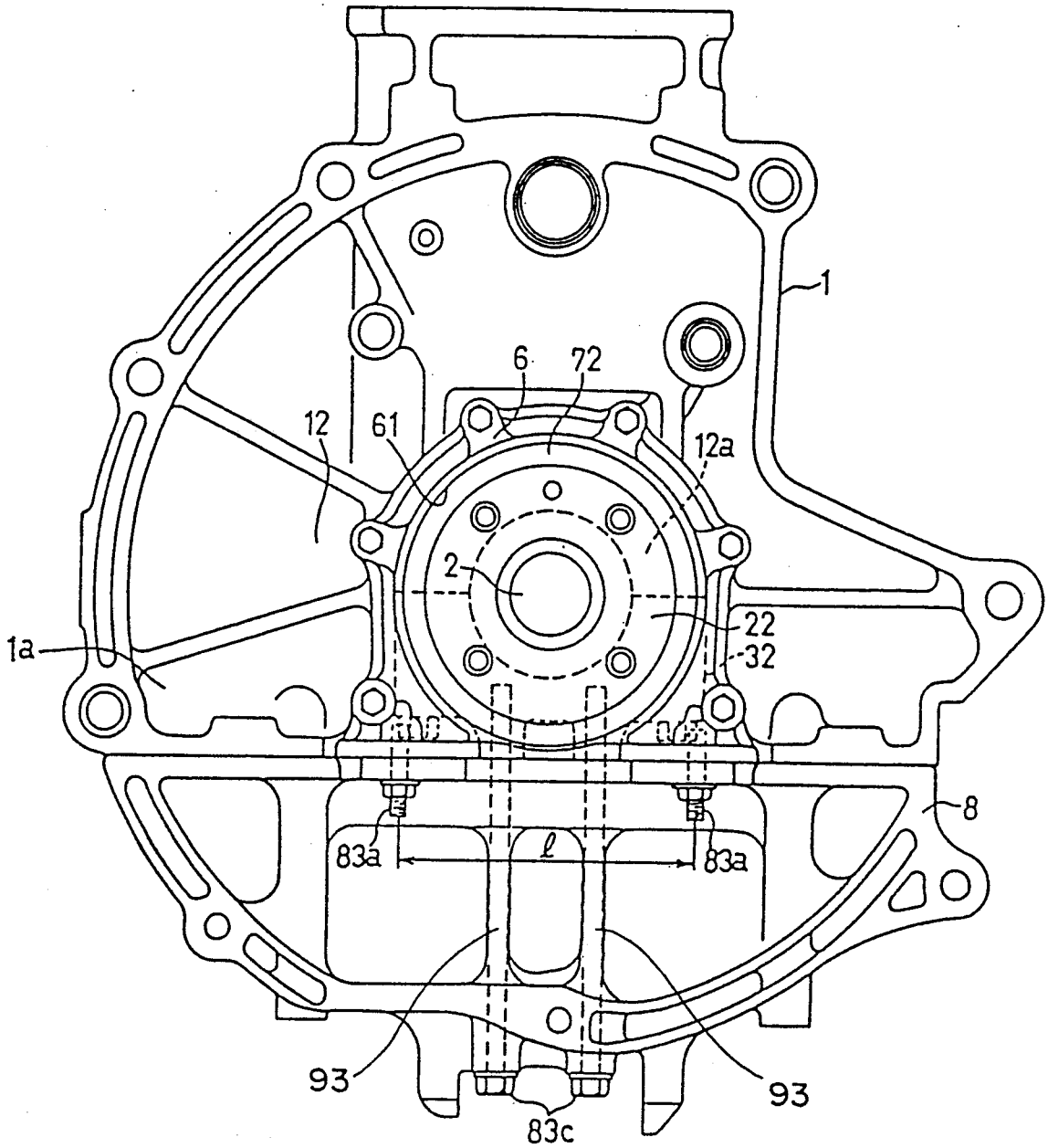
FIG. 2 is a rear view of the cylinder block of FIG. 1.

As shown in FIG. 2, the fastening bolts 83*a* are provided on opposite sides of the rear cover 6 and located away from the relatively thin central portion of the rear cover 6 in the vicinity of the inner periphery of the opening 61. The fastening bolts 83*c* are located inside the fastening bolts 83*a* in the direction transversely of the cylinder block 1. In other words, the distance between the fastening bolts 83*c* is rendered to be shorter than a bolt pitch l of the fastening bolts 83*a*. The bolt holes 85 for receiving the fastening bolts 83*c* are reinforced by respective ribs 93, as best seen in FIG. 2.

As described above, in the reinforced structure of the cylinder block according to the present invention, the reinforcing member 8 is fastened to the main bearing cap 32 near the rear cover 6 by the fastening bolts 83*c*. Furthermore, the fastening bolts 83*c* are located within the pitch l of the fastening bolts 83*a*. Because of this, the fastening force caused by the fastening bolts 83*c* acts upon the joint between the rear cover 6 and the reinforcing member 8 in the vicinity of the fastening bolts 83*c* so that the reinforcing member 8 may be pressed against the rear cover 6 at a location between the fastening bolts 83*a*. As a result, the surface pressure of the joint between the fastening bolts 83*a* is raised, thereby preventing oil leakage through between the rear cover 6 and the reinforcing member 8.

Since the surface pressure of the joint between the fastening bolts 83*a* is sufficiently ensured, the fastening bolts 83*a* can be placed in such locations that the rear cover 6 is considerably thick by extending the pitch l of the fastening bolts 83*a*.

It is to be noted that the rear cover 6 may be integrally formed with the cylinder block 1.

It is also to be noted that the oil pan 9 may be incorporated into the reinforcing member 8.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. In an internal combustion engine having a cylinder block, a skirt portion integrally formed therewith at a lower portion thereof, a plurality of bearings received therein, a crank shaft journaled in the bearings, a plurality of bearing caps secured to the bearings, and front and rear covers formed at front and rear portions of the cylinder block, respectively, and having respective openings through which the crank shaft extends, said cylinder block having a reinforced structure comprising:

a reinforcing member secured to a lower surface of said skirt portion of said cylinder block and to a lower surface of said rear cover;

at least two first bolts, provided on opposite sides of said rear cover, for fastening said reinforcing member to the lower surface of said rear cover; and at least two second bolts for fastening said reinforcing member to a bearing cap for a rearmost bearing of said bearings, said second bolts being placed within a pitch of said first bolts in a direction transversely of said cylinder block.

2. The structure according to claim 1, wherein said reinforcing member has at least two reinforcing ribs at a rear portion thereof, in which respective openings are formed, said second bolts extending through said openings.

3. The structure according to claim 1, further comprising an oil seal interposed between an inner periphery of said rear cover and an outer periphery of a rear end of said crank shaft, said first bolts being placed on opposite sides of said oil seal and said second bolts being placed in the vicinity of said oil seal.

4. The structure according to claim 3, wherein a rear end of said crank shaft is greater in diameter than a front end thereof.

5. The structure according to claim 1, wherein an oil pan is incorporated into said reinforcing member.

* * * * *